United States Patent [19]

Husain et al.

[11] 4,270,358

[45] Jun. 2, 1981

[54] APPARATUS AND METHODS OF COOLING A HOT FLUID STREAM

[75] Inventors: Matloob Husain, Wheaton; Ban-Yen Lai, Willowbrook; Richard L. Schmitt, Batavia, all of Ill.

[73] Assignee: Chicago Bridge & Iron Company, Oak Brook, Ill.

[21] Appl. No.: 42,364

[22] Filed: May 25, 1979

[51] Int. Cl.[3] ..... F28B 7/00; F28B 1/02; F28B 9/06

[52] U.S. Cl. ..... 60/693; 165/110; 165/DIG. 1; 165/104.25; 62/115; 62/506

[58] Field of Search ..... 165/DIG. 1, 107, 45, 165/104 S, 110, 111; 60/693; 62/506, 115

[56] References Cited

U.S. PATENT DOCUMENTS

| | | | |
|---|---|---|---|
| 3,635,042 | 1/1972 | Spangemacher | 165/DIG. 1 X |
| 3,820,334 | 6/1974 | Heller et al. | 165/DIG. 1 X |
| 3,841,100 | 10/1974 | Fortescue et al. | 165/DIG. 1 X |
| 3,881,548 | 5/1975 | Budenholzer | 60/693 X |
| 4,139,056 | 2/1979 | Scholl | 165/45 X |
| 4,144,723 | 3/1979 | Morse et al. | 62/332 |

OTHER PUBLICATIONS

Rossie, J. P. et al., *Dry-Type Cooling Towers Part I*, Water Quality Office, EPA, Project 16130EES, Contract 14-12-823, 11/1970, pp. 113-116.

*Primary Examiner*—Albert W. Davis
*Attorney, Agent, or Firm*—Merriam, Marshall & Bicknell

[57] ABSTRACT

A hot fluid stream is cooled by contacting it, in indirect heat exchange, with a base cooling fluid so long as the base cooling fluid accepts heat rejected from the hot fluid stream and adequately cools the same. When the cooling capacity of the base cooling fluid is inadequate supplemental cooling is provided contemporaneously and indirectly by contacting the hot fluid stream with a secondary cooling liquid which is cold thereby heating the secondary cooling liquid. The heated secondary cooling liquid is delivered to a hot reservoir for storage. The hot secondary cooling liquid is later removed from the hot reservoir, cooled and delivered to a cold reservoir for storage. The cold secondary cooling liquid is removed when needed from the cold reservoir and again delivered into indirect heat exchange with the hot fluid stream when the base cooling fluid provides inadequate cooling for the hot fluid stream.

The base cooling fluid can be a refrigerant such as ammonia and the secondary cooling liquid can be water. The hot fluid stream can be steam condensed in a condenser of an electric power generating plant.

27 Claims, 3 Drawing Figures

APPARATUS AND METHODS OF COOLING A HOT FLUID STREAM

This invention relates to apparatus and methods of cooling and/or condensing a hot fluid stream. More particularly, this invention pertains to apparatus and methods of cooling and/or condensing a hot fluid stream using a supplementary or peak shaving cooling system which supplies necessary additional cooling when a base cooling system maximum capacity or duty is exceeded, such as on hot days.

Many commercial and industrial processes generate large amounts of waste heat which must be removed for successful operation. The waste heat is often carried in the form of a hot fluid stream. For a number of reasons, it is often undesirable or impermissible for the hot fluid stream to be disposed of so it must be cooled and reused. One such hot fluid stream is spent steam, such as from an electric power generating steam turbine, which is condensed to water which then is reconverted to steam in a boiler to be used again in powering the turbine.

Regardless of the source of the hot fluid stream, a base cooling system of one type or another is provided for cooling the hot fluid stream. All such systems rely, ultimately, on heat rejection to the environment, either by direct rejection, or indirectly through an intermediate fluid, to air or to water from a river, lake or sea.

A typical cooling system can be illustrated further by reference to a power generating plant. In the production of electric power, heat is first produced by nuclear energy or combustion of a fossil fuel such as oil, gas or coal. The heat produced is then used to convert water into steam. The steam is conducted at high pressure to a turbine which it drives. The turbine is, of course, coupled to a generator which produces electric power. The spent steam from the turbine is condensed by the cooling system and then recycled and reheated to steam again.

An air cooled system is generally designed and built to provide a cooling capacity or duty adequate for the intended purpose on the hottest day, or ambient temperature, anticipated at the site of the plant involved. This results in an excess cooling capacity for all but a small number of days out of a year. Even on the hottest days, the maximum cooling capacity of the system often is not utilized except during the very warmest part of the day. This is because the atmospheric temperature from day to night will vary as much as, or more than, 20 to 30° F., making it unnecessary to utilize the maximum cooling capacity of the system most of each day. The cooling system installation, operation and maintenance involve large costs and expenses which cover a system that is not anywhere fully employed regardless of the hot fluid stream to be cooled.

A water cooled system is generally designed for the highest temperature of the water from the available source e.g. river, lake or sea. The cooling water picks up heat in condensing the steam. The heated water is disposed of into the river, and lake or sea but this is undesirable in certain areas because it causes the temperature of natural bodies of water to rise excessively, leading to ecological imbalance.

As an alternative, many power generating plants cool the heated water in an evaporative cooling tower by contacting it with ambient air. Large natural or mechanical draft cooling towers are extensively used for this purpose. While the heated water is cooled in this manner, a substantial amount is expelled as water vapor which may form artificial clouds leading to fog, ice and other problems in addition to the loss of fresh water which is increasingly scarce.

An evaporative cooling tower serving a 1000 megawatt electric generating plant may lose as much as 800,000 gallons of water per hour into the atmosphere. Also, the evaporative towers are susceptible to large bacteria growth causing additional environmental problems.

Various dry-type cooling systems have also been proposed. In one such system, ammonia is used in a closed loop cycle to absorb heat in the steam condenser of a power generating plant and then reject heat in a cooling tower where air absorbs the heat from the ammonia coolant. This process is not very economical in comparison to an evaporative or once-through water cooling system. One of the shortcomings of the system is that the temperature of the ammonia refrigerant entering the cooling tower is close to the temperature of the condensing steam, which in power plants ranges between 100° and 135° F. When the weather is hot and the ambient air flowing through the tower, for example, is about 95° F. or above, the temperature differential between the ammonia coolant and the ambient air is smaller than desired for efficient heat exchange. Also, the cooling tower cannot be designed for natural draft because of low differential temperatures between ambient air and the coolant temperature. To promote more efficient heat exchange in the cooling tower, the steam condensing temperatures may be increased but this leads to a higher turbine back pressure and lower turbine efficiency with a corresponding drop in power output. When the air temperature is lower than 90° F., better cooling is effected but the high costs of providing for peak ambient temperatures make the system uneconomical.

From the above discussion, it is clear that there is a need for a system or apparatus, and an appropriate method, for effecting cooling of a hot fluid stream which permits a reduction in the size of the base cooling system but which provides a cooling capacity suitable for the maximum duty imposed on it on the hottest days of operation.

According to one aspect of the subject invention, there is provided a method of cooling a hot fluid stream by contacting the hot fluid stream in indirect heat exchange with a base cooling fluid so long as the base cooling fluid accepts heat rejected from the hot fluid stream and adequately cools the same, supplementing the cooling capacity of the base cooling fluid when it provides inadequate cooling by contemporaneously also indirectly contacting the hot fluid stream with a secondary cooling liquid which is cold thereby heating the secondary cooling liquid, delivering the heated secondary cooling liquid to a hot reservoir for storage, removing the hot secondary cooling liquid from the hot reservoir, cooling it and delivering the cold secondary cooling liquid to a cold reservoir for storage, and withdrawing cold secondary cooling liquid from the cold reservoir and again delivering it into indirect heat exchange with the hot fluid stream when the base cooling fluid provides inadequate cooling for the hot fluid stream.

Although the described method can be suitably employed with a hot fluid stream from nearly any source, it is especially useful when the hot fluid stream is waste steam from a steam driven turbine.

Even though the method can be practiced in a way in which the base cooling fluid is discarded, the method is highly useful when the base cooling fluid is heated by absorption of heat from the hot fluid stream, the hot base cooling fluid is cooled by passing it through a cooling tower and then is returned to again accept heat rejected by the hot fluid stream.

In a particularly useful method, the base cooling fluid can be a refrigerant, in a closed loop refrigeration cycle. The base cooling fluid or refrigerant can be converted from a liquid to a vapor by heat rejected to it from the hot fluid stream, and the vapor condensed to a liquid in passing through the cooling tower.

Regardless of the source of the hot fluid stream, the hot base cooling fluid is desirably cooled in a cooling tower by indirect heat rejection to air. In a particular method, the temperature of the air, the size of the cooling tower and the rate of air flow through the cooling tower provide a limit as to the cooling of the hot fluid stream which can be effected by the base cooling fluid on hot days so that when such cooling is inadequate, supplemental cooling by means of the secondary cooling liquid is activated. Furthermore, the hot secondary cooling liquid can be removed from the hot reservoir and be indirectly cooled at least partially by air. In a similar manner, the hot secondary cooling liquid can be removed from the hot reservoir and be indirectly cooled at least partially by the base cooling fluid following cooling in the cooling tower.

For a highly efficient operation in an electric generating power plant the hot secondary cooling liquid can be cooled primarily during evening hours when demand for power is reduced and then the cold secondary cooling liquid used during daylight hours to cool the hot fluid stream when the demand for power and cooling of the hot fluid stream is highest. In such an operation, the hot fluid stream could be waste steam from a steam driven turbine used to generate electric power, with the steam condensed to water in a surface condensor.

According to a further aspect of the invention, there is provided novel cooling apparatus comprising a first heat exchanger sized to adequately cool a hot fluid stream passed into contact therewith by rejection of heat to a first cooling fluid up to a maximum temperature of the cooling fluid, means to pass the hot fluid stream through the first heat exchanger in indirect heat exchange with the first or base cooling fluid, a second heat exchanger for cooling the hot fluid stream when heat rejection therefrom to the first cooling fluid alone provides inadequate cooling of the hot fluid stream, the second heat exchanger being arranged to be in a position selected from a series and parallel position with respect to the first heat exchanger, means to pass the hot fluid stream through the second heat exchanger, a hot reservoir for a secondary cooling liquid when hot, a cold reservoir for the same secondary cooling liquid when cold, a conduit from the cold reservoir to the second heat exchanger for supplying the cold secondary cooling liquid in indirect heat exchange to the hot fluid stream passed through the second heat exchanger, a conduit for withdrawing the hot secondary cooling liquid from the second heat exchanger and delivering it to the hot reservoir, a conduit communicating with the hot reservoir and a cooler for delivering the hot secondary cooling liquid from the hot reservoir to the cooler to be cooled, and a conduit communicating with the cooler and the cold reservoir for delivering the cold secondary cooling liquid from the cooler to the cold reservoir.

Although the first cooling fluid can be some other substance, it will usually be air, water a refrigerant such as ammonia, or a combination of such materials which are compatible in the system.

The first cooling fluid can be in a closed loop having means for cooling the first cooling fluid after it is heated by passage through the first heat exchanger. The first cooling fluid in such a closed loop can be a refrigerant, and the closed loop can be part of a refrigeration cycle. The first cooling fluid in such a system would enter the first heat exchanger as a liquid and leave as a vapor. The means for cooling the first cooling fluid after it is heated can be a cooling tower in which heat is rejected to water, air or both.

In a particular embodiment of the apparatus, the first and second heat exchangers can be located in the steam condensor of a steam powered turbine. In additon, the apparatus can include a closed loop containing the first cooling fluid, and a cooling tower for cooling the first cooling fluid after it is heated by passage through the first heat exchanger, said cooling tower functioning by rejecting heat to the air.

The apparatus of the invention is considered especially useful when the secondary cooling liquid fed to the second heat exchanger is water. In this regard, when water is used, or any other liquid, the cold reservoir and the hot reservoir are desirably enclosed. Thus, the cold reservoir and the hot reservoir can be separate tanks, or the two reservoirs can be stratified in the same tank and be separated by difference in gravity, or they can be physically separated by a barrier membrane.

The cooler, in which the hot secondary cooling liquid is cooled, can reject heat at least in part to air, or to the first cooling fluid when it is cold, or to both.

The invention will be described further in conjunction with the attached drawings in which.

Figure 1:
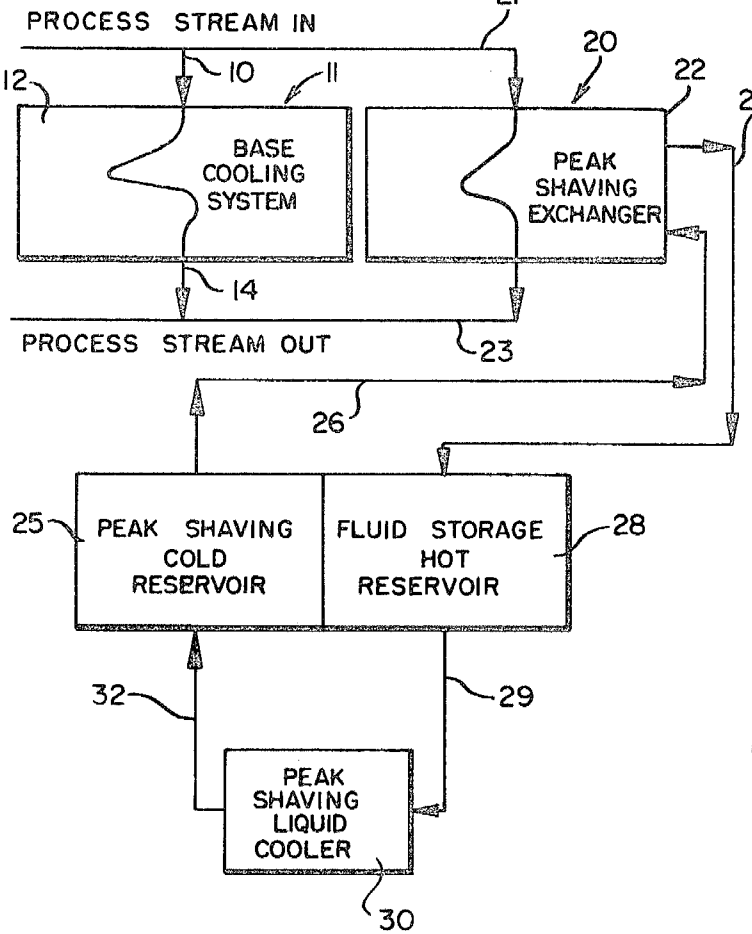
FIG. 1 is a diagrammatic drawing illustrating broadly a combination of apparatus provided by the invention for cooling a hot fluid stream.

With reference to FIG. 1, a hot fluid process stream is fed by conduit 10 through a base cooling system 11 containing a heat exchanger 12 which can be cooled by a suitable fluid such as air, water, a mixture thereof, or by means of a refrigeration cycle. Regardless of the fluid used, the base cooling system is designed and sized to provide less than all the cooling duty required to cool the hot fluid process stream, such as when the temperature is above a pre-determined average summer temperature or when there are restrictions on the amount of the cooling fluid used in the base cooling system. The cooled process fluid is removed by conduit 14 from the base cooling system and then delivered to an appropriate destination, such as for reuse.

On those days during the year when the base cooling system 11 is inadequate to cool the hot fluid process stream, the necessary additional cooling capacity is provided by a supplemental or peak shaving cooling system 20 which can be placed in series with the base cooling system 11 although a parallel arrangement is illustrated in FIG. 1. With the parallel arrangement, part of the hot fluid process stream is fed by conduit 21 through heat exchanger 22, where it is cooled, and out conduit 23. A cold secondary liquid is supplied from storage reservoir 25 by conduit 26 to heat exchanger 22 in which it is indirectly heated by heat rejected to it by the hot fluid process stream. The hot secondary cooling liquid is withdrawn from heat exchanger 22 by conduit 27 which delivers it to hot secondary cooling liquid storage reservoir 28.

The hot secondary cooling liquid is retained in reservoir 28 until such time as it is advantageous to cool it. Generally, the most expeditious period for cooling the hot secondary cooling liquid is at nighttime when excess power is available to operate cooler 30 and when the temperature of the air usually is at a minimum. Hot secondary cooling liquid is withdrawn by conduit 29 from hot reservoir 28 and fed through cooler 30 from which it is fed by conduit 32 to the cold reservoir 25. It will be readily appreciated that the volume of liquid used in the supplemental or peak shaving system 20 and the amount of heat rejected to it by the hot fluid process stream must be adequate to provide complementary cooling which when combined with the cooling supplied by the base cooling system will meet the total cooling duty required by the hot fluid process stream. The rate of secondary cooling liquid circulation is controlled to match the difference between the process stream duty and the capacity of the base cooling system.

The cooling system described in conjunction with FIG. 1 can be used to cool a hot fluid process stream from one of many sources, such as a power plant, refinery, petrochemical plant, steel plant and copper smelter.

Figure 2:
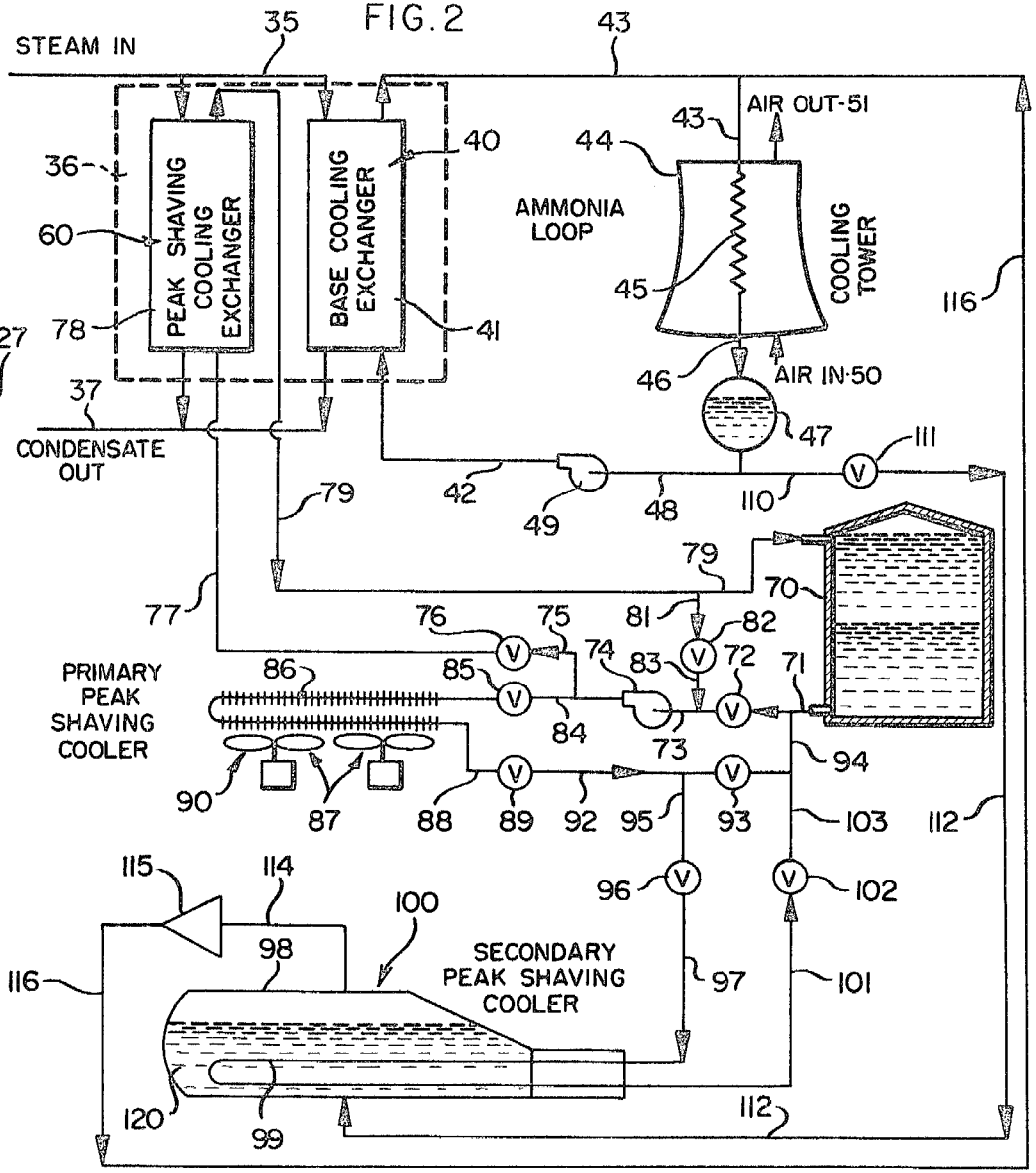
FIG. 2 is a diagrammatic drawing of apparatus according to the invention in which a closed loop refrigeration cycle is used in a base cooling system to condense spent steam.

FIG. 2 illustrates a second embodiment of the invention and one particularly adaptable for dry cooling in an electrical energy generating plant. As shown in FIG. 2, spent steam from a steam-driven turbine is delivered by conduit 35 to a steam condensor 36 which is usually cooled by a base cooling system 40 and, when needed, a peak shaving system 60. The condensate is removed by conduit 37 from heat exchanger 41, and peak shaving heat exchanger 78 subsequently described.

Base cooling system 40 includes a heat exchanger 41, located in steam condenser 36, which is an integral part of a closed loop refrigeration cycle using ammonia as the refrigerant. Ammonia which has been cooled and condensed to a liquid is supplied by conduit 42 to heat exchanger 41. The heat rejected by the condensing steam vaporizes the ammonia. The ammonia vapor is removed from heat exchanger 41 by conduit 43 and passed through a heat exchanger 45 located in cooling tower 44, which can be a natural draft, forced or induced draft air cooled type. Air 50 at ambient or atmospheric temperature enters the bottom of the cooling tower 44 and the heated air 51 flows out the top of the tower. The ammonia condenses in the tower 44 and is delivered from the heat exchanger 45 by conduit 46 to liquid ammonia receiver 47. Conduit 48 delivers liquid ammonia from receiver 47 to pump 49 from which it is delivered to conduit 42. The described ammonia refrigeration cycle is sized to provide a cooling capacity which is adequate to remove all of the heat rejected by the steam fed to the steam condensor during those days in the summer when the air temperature stays below a design temperature, such as 85° F. When the air temperature goes above such a temperature, the extra cooling capacity is provided by supplementary or peak shaving cooling system 60 which will now be described.

The peak shaving cooling system 60 includes a heat exchanger 78 in steam condensor 36, a secondary cooling liquid storage tank 70, a primary cooler 90 and a secondary cooler 100, together with conduits and valves to effect cooling liquid routing and control.

Cold secondary cooling liquid is withdrawn from the bottom of tank 70 by conduit 71 and fed through open valve 72 to conduit 73 which delivers it to pump 74. Pump 74 delivers the cold secondary cooling liquid to conduit 75 which feeds it through open valve 76 to conduit 77. Conduit 77 delivers the cold secondary cooling fluid to heat exchanger 78. Heat rejected by condensing steam in steam condensor 36 heats the secondary cooling fluid. The hot secondary cooling fluid is withdrawn from heat exchanger 78 by conduit 79 which delivers it to the top portion of tank 70 where it forms a stratified hot reservoir volume on top of the cold reservoir volume of secondary cooling fluid in the lower portion of the tank. Even though the hot and cold secondary cooling fluid volumes fluctuate during operation of the system, the volumes remain separate or stratified because of the different densities of the hot and cold cooling fluid, particularly when it is water. During use of the peak shaving cooling system as described, valves 82, 85, 93 and 102 are closed. No cooling liquid is consumed or discarded in the described system and all heat is rejected to air instead of to a lake or stream. It is essential, of course, for optimum operation of the described peak shaving system to have a sufficient volume of cold secondary cooling liquid in tank 70 to supply the necessary cooling, at least on a day-by-day basis. It is contemplated that tank 70 will store a sufficient volume of secondary cooling liquid to adequately supplement the base cooling system during the daily hours of maximum temperature, such as from about 11 A.M. to 4 P.M.

Cooling of the hot secondary cooling liquid for subsequent reuse in the peak shaving cooling system is preferably effected at night when excess electrical power is available and the air temperature has dropped, thereby increasing heat exchange with low cost. When the air temperature is adequately low, the hot secondary cooling liquid is removed from tank 70 and conveyed by conduit 79 to conduit 81 which delivers it through open valve 82 to conduit 83. Conduit 83 feeds the hot secondary cooling liquid to conduit 73 from which it is fed to pump 74. Pump 74 delivers the hot secondary cooling liquid to conduit 84 and it delivers it through open valve 85 to heat exchanger 86 of primary cooler 90. Fans 87 blow air around the heat exchanger to improve heat rejection to the air. Conduit 88 receives the cold secondary cooling liquid from heat exchanger 86 and feeds it through open valve 89 to conduit 92. From conduit 92 the cold secondary cooling liquid flows through open valve 93 to conduit 94 and from it to tank 70. During this cooling operation, valves 72, 76, 96 and 102 are closed.

In the event the secondary cooling liquid is not cooled sufficiently in primary cooler 90, it can be further cooled in secondary cooler 100. Thus, the cool secondary cooling liquid can be fed by conduit 92, with valve 93 closed, to conduit 95 and by it through open valve 96 to conduit 97 which delivers it to tube bundle 99 in ammonia reboiler 98. The ammonia reboiler 98 contains a cold volume of liquid ammonia 120. The cold secondary cooling liquid is fed from tube bundle 99 to conduit 101 and by it through open valve 102 to conduit 103 which delivers it to conduit 94. Conduit 94 feeds the cold secondary cooling liquid to conduit 71 which delivers it to the bottom of tank 70.

Liquid ammonia is supplied to reboiler 98 from receiver 47 by feeding it by means of conduit 110 through open valve 111 to conduit 112 which delivers it to reboiler 98. The ammonia vapor released in reboiler 98 is removed by conduit 114, compressed by compressor 115 and delivered to conduit 116. Conduit 116 delivers the ammonia vapor to conduit 43 which feeds it to heat exchanger 45 in cooling tower 44. The ammonia is thereby condensed and delivered from the heat exchanger to conduit 46 and by means of it to liquid ammonia receiver 47.

The described peak shaving process and apparatus enable sizing the base cooling system for an average air temperature considerably lower than the maximum air temperature, thus reducing the capital cost and power consumption involved when a base cooling system is sized for maximum air temperature to be experienced thereby providing much more cooling capacity for most of the year than is needed. The peak shaving system of this invention is predicated on the fact that maximum air temperatures are experienced only for a few hours on any given day, and that most day to night temperature swings are 25° to 30° F. thus permitting cooling of the hot cooling liquid at night using electrical power not needed because of reduced nighttime demand compared to daylight power consumption.

The rate of secondary cooling liquid circulation in the peak shaving system will, of course, be controlled to match the difference between the hot fluid process stream duty and the cooling capacity of the base cooling system.

Figure 3:
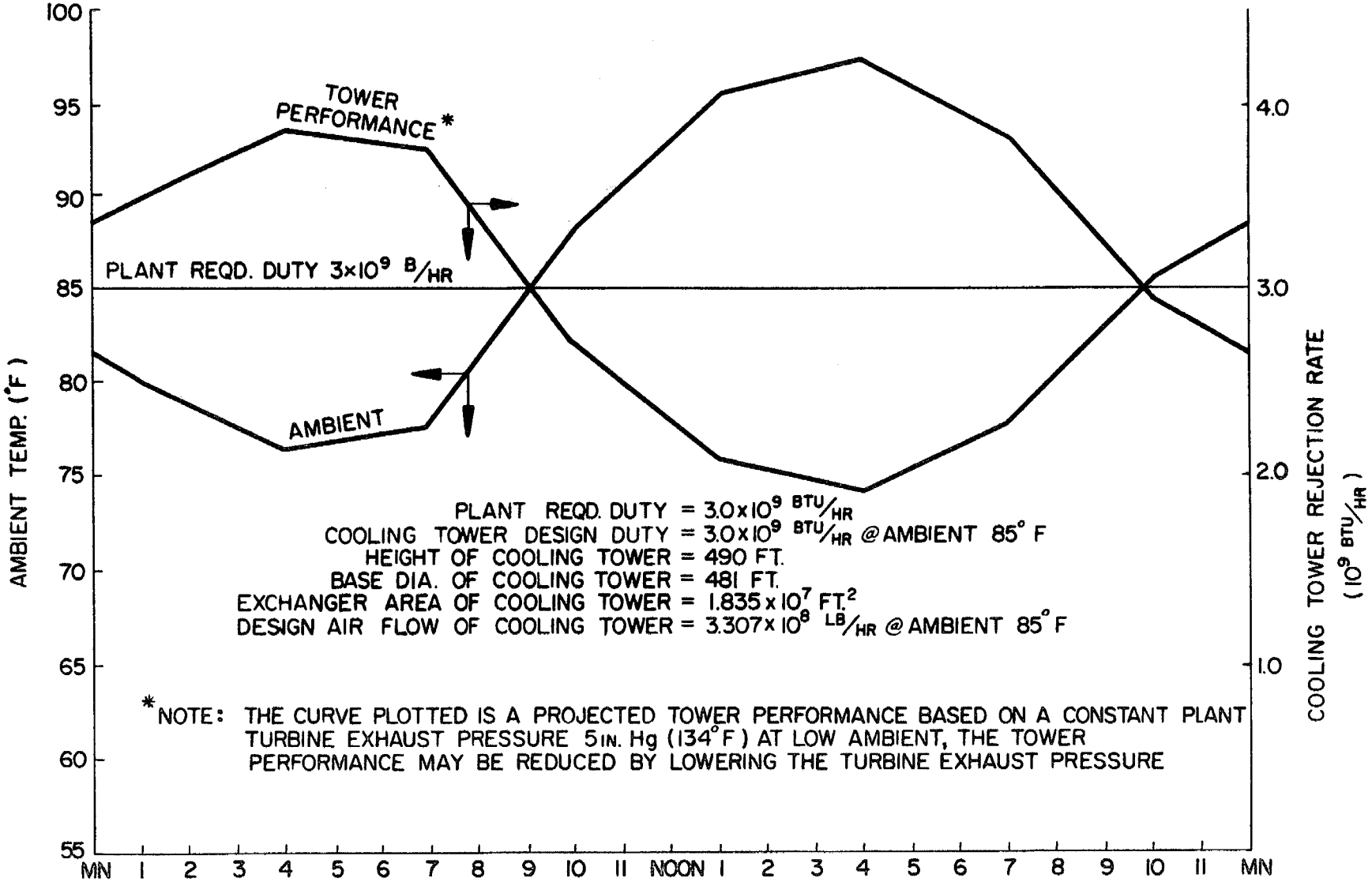
FIG. 3 is a graph correlating the cooling capacity of the apparatus shown in FIG. 2 with ambient or atmospheric air temperature and the hour of the day.

FIG. 3 illustrates graphically the daily cooling requirements on an hourly basis for a 1000 MW electrical generating plant. The base cooling system and the peak shaving cooling system illustrated by FIG. 2 provide the basis for the curves constituting the graph. Water is proposed as the cooling liquid for peak shaving cooling. The data in the following Table 1 illustrates operating conditions when the atmospheric air is at 77.5° F., 85° F. and 97.5° F. At 77.5° F., the system stores refrigeration in the form of cold secondary cooling water and operation of the peak shaving section is not required. At 85° F., operation of the peak shaving section is still not required but refrigeration is not being stored in the secondary cooling water. When the air is at 97.5° F., the cold secondary cooling water is used to supplement the base cooling system of the ammonia refrigeration cycle.

TABLE 1

| | | | | | | | | | | | | | | | |
|---|---|---|---|---|---|---|---|---|---|---|---|---|---|---|---|
| SYSTEM OPERATING AT AMBIENT 97.5° F. | | | | | | | | | | | | | | | |
| Drawing No. | 5 | 37 | 42 | 43 | 43 | 48 | 77 | 79 | 81 | 95 | 94 | 114 | 116 | 50 | 51 |
| Temp. (°F.) | 34 | 134 | 132 | 131 | 131 | 130 | 73 | 130 | — | — | — | — | — | 97.5 | 126 |
| Pressure (PSIA) | "Hg | 5"Hg | 340 | 335 | 335 | 329 | 40 | 35 | — | — | — | — | — | 14.6 | 14.591 |
| Flow (LB/HR) | .944 | 2.944 | 4.366 $\times 10^6$ | 4.366 $\times 10^6$ | 4.366 $\times 10^6$ | 4.366 $\times 10^6$ | 1.88 $\times 10^7$ | 1.88 — | — | — | — | — | — $\times 10^8$ | 2.93 $\times 10^8$ | 2.93 |
| Remarks | $10^9$ BTU/HR Heat rejected from steam | | 1.93 $\times 10^9$ BTU/HR Transferred to ammonia | | | | 1.07 $\times 10^9$ BTU/HR Transferred to water | | | | | | | 1.93 $\times 10^9$ BTU/HR Rejected to atmosphere | |
| SYSTEM OPERATING AT DESIGN AMBIENT 85° F. | | | | | | | | | | | | | | | |
| Drawing No. | 5 | 37 | 42 | 43 | 43 | 48 | 77 | 79 | 81 | 95 | 94 | 114 | 116 | 50 | 51 |
| Temp. (°F.) | 34 | 134 | 131 | 130 | 130 | 129 | — | — | — | — | — | — | — | 85 | 123 |
| Pressure (PSIA) | "Hg | 5"Hg | 334 | 329 | 329 | 324 | — | — | — | — | — | — | — | 14.6 | 14.589 |
| Flow (LB/HR) | .944 | 2.944 | 6.766 $\times 10^6$ | 6.766 $\times 10^6$ | 6.766 $\times 10^6$ | 6.766 $\times 10^6$ | — | — | — | — | — | — | — | 3.307 $\times 10^8$ | 3.307 $\times 10^8$ |
| Remarks | $10^9$ BTU/HR Heat rejected from steam | | 3 $\times 10^9$ BTU/HR Transferred to ammonia | | | | No need to operate the peak shaving system | | | | | | | 3 $\times 10^9$ BTU/HR Rejected to atmosphere | |
| SYSTEM OPERATING AT AMBIENT 77.5° F. (70% Peak Shaving Load On Primary) | | | | | | | | | | | | | | | |
| Drawing No. | 5 | 37 | 42 | 43 | 43 | 48 | 77 | 79 | 81 | 95 | 94 | 114 | 116 | 50 | 51 |
| Temp. (°F.) | 29 | 129 | 126 | 125 | 124 | — | — | 130 | 90 | 73 | 68 | 125 | 77.5 | 119 | |
| Pressure (PSIA) | 38"Hg | 4.38"Hg | 312 | 307 | 307 | 302 | — | — | 35 | 40 | 35 | 125 | 307 | 14.6 | 14.587 |
| Flow (LB/HR) | .944 | 2.944 | 6.656 $\times 10^6$ | 6.656 $\times 10^6$ | 6.656 $\times 10^6$ | 6.656 $\times 10^6$ | — | — | 1.886 $\times 10^7$ | 1.886 $\times 10^7$ | 1.886 $\times 10^7$ | 8.408 $\times 10^5$ | 8.408 $\times 10^5$ | 3.6 $\times 10^8$ | 3.6 $\times 10^8$ |
| Remarks | .981 $10^9$ BTU/HR rejected from steam | | 2.981 $\times 10^9$ BTU/HR Transferred to ammonia | | | | No need to operate the peak shaving system | | Refrigeration stored in peak shaving system for 7 hours 430,720 BBL of water needed 8.623 $\times 10^9$ BTU total peak shaving load | | | $NH_3$ compressor 24347 HP Secondary cooler duty = 3.6954 $\times 10^8$ BTU/HR | | 3.4125 $\times 10^9$ BTU/HR rejected to atmosphere | |

The foregoing detailed description has been given for clearness of understanding only, and no unnecessary limitations should be understood therefrom as modifications will be obvious to those skilled in the art.

What is claimed is:

1. Apparatus comprising:

a first heat exchanger sized to cool and/or condense a hot fluid stream passed into contact therewith by rejection of heat to a first cooling fluid up to an average predetermined temperature and flow of the first cooling fluid, with said heat exchanger having inadequate cooling capacity during peak cooling conditions, means to pass the hot fluid stream through the first heat exchanger in indirect heat exchange with the first cooling fluid, a second heat exchanger for cooling the hot fluid stream when heat rejection therefrom to the first cooling fluid alone provides inadequate cooling of the hot fluid stream in the first heat exchanger, the second heat exchanger being arranged to be in a series or parallel position with respect to the first heat exchanger, means to pass the hot fluid stream through the second heat exchanger, a hot reservoir for a secondary cooling liquid when hot, a cold reservoir for the secondary cooling liquid when cold, the capacities of the hot and cold reservoirs being adequate to hold the entire volume of secondary cooling liquid for the peak cooling conditions, a conduit from the cold reservoir to the second heat exchanger for supplying cold secondary cooling liquid in indirect heat exchange to the hot fluid stream passed through the second heat exchanger, a conduit for withdrawing hot secondary cooling liquid from the second heat exchanger and delivering it to the hot reservoir, a conduit communicating with the hot reservoir and a cooler for delivering hot secondary cooling liquid from the hot reservoir to the cooler to be cooled, and a conduit communicating with the cooler and the cold reservoir for delivering cold secondary cooling liquid from the cooler to the cold reservoir.

2. Apparatus according to claim 1 in which the first cooling fluid is a refrigerant gas, air or water.

3. Apparatus according to claim 1 including a closed loop containing the first coolng fluid, and means for cooling the first cooling fluid after it is heated by passage through the first heat exchanger.

4. Apparatus according to claim 3 in which the means for cooling the first cooling fluid after it is heated comprises a cooling tower in which heat is rejected to water, air or both.

5. Apparatus according to claim 1 in which the first and second heat exchangers are located in the steam condensor of a steam powered turbine.

6. Apparatus according to claim 5 including a closed loop containing the first cooling fluid, and a cooling tower for cooling the first coolng fluid after it is heated by passage through the first heat exchanger, said cooling tower functioning by rejecting heat to the air.

7. Apparatus according to claim 1 in which the cooling liquid fed to the second heat exchanger is water.

8. Apparatus according to claim 7 in which the cold reservoir and the hot reservoir are enclosed.

9. Apparatus according to claim 8 in which the cold reservoir and the hot reservoir are in the same enclosed tank.

10. Apparatus according to claim 1 in which the cooler, in which the hot secondary cooling liquid is cooled, rejects heat at least in part to air.

11. Apparatus according to claim 1 in which the cooler has means to reject heat from the hot secondary cooling liquid to the first cooling fluid when it is cold.

12. Apparatus according to claim 3 in which the first cooling fluid is a gas, the closed loop is part of a refrigeration cycle, and the first cooling fluid enters the first heat exchanger as a liquid and leaves as a vapor.

13. Apparatus comprising:

a steam condensor of a steam turbine containing a first heat exchanger and a second heat exchanger, the first heat exchanger being sized to condense spent steam in the condensor by passage of a first cooling fluid through the heat exchanger up to an average predetermined temperature and flow of the first cooling fluid, with said heat exchanger having inadequate cooling capacity during peak cooling conditions, a second heat exchanger in the condensor for condensing steam when heat rejection therefrom to the first cooling fluid alone provides inadequate cooling in the first heat exchanger, a hot reservoir for a secondary cooling liquid when hot, a cold reservoir for the secondary cooling liquid when cold, the capacities of the hot and cold reservoirs being adequate to hold the entire volume of secondary cooling liquid for the peak cooling conditions, a conduit from the cold reservoir to the second heat exchanger for withdrawing cold secondary cooling liquid from the cold reservoir and supplying it to the second heat exchanger in indirect heat exchange in the steam condensor, a conduit for withdrawing hot secondary cooling liquid from the second heat exchanger and delivering it to the hot reservoir, a conduit communicating with the hot reservoir and a cooler for delivering hot secondary cooling liquid from the hot reservoir to the cooler to be cooled, and a conduit communicating with the cooler and the cold reservoir for delivering cold secondary cooling liquid from the cooler to the cold reservoir.

14. Apparatus according to claim 13 in which the cooler includes at least a portion which is air cooled.

15. Apparatus according to claim 13 in which the cooler includes at least a portion which is cooled by the first cooling fluid.

16. A method of cooling a hot fluid stream which comprises:

contacting a hot fluid stream in indirect heat exchange with a base cooling fluid so long as the base cooling fluid accepts heat rejected from the hot fluid stream and adequately cools the same, supplementing the cooling of the hot fluid stream when the base cooling fluid provides inadequate cooling thereof, by contemporaneously also indirectly contacting the hot fluid stream with a secondary cooling liquid which is cold thereby heating the secondary cooling liquid, delivering the hot secondary cooling liquid to a hot reservoir for storage with said hot reservoir having a capacity adequate to hold the entire volume of secondary cooling liquid, removing the hot secondary cooling liquid from the hot reservoir, cooling it and delivering the cold secondary cooling liquid to a cold reservoir for storage with said cold reservoir having a capacity adequate to hold the entire volume of secondary cooling liquid, and withdrawing cold secondary cooling liquid from the cold reservoir and again delivering it into indirect heat exchange with the hot fluid stream when the base cooling fluid provides inadequate cooling.

17. A method according to claim 16 in which the hot fluid stream is waste steam from a steam driven turbine.

18. A method according to claim 16 in which the base cooling fluid is heated by absorption of heat from the hot fluid stream, the hot base cooling fluid is cooled by passing it through a cooling tower and then is returned to again accept heat rejected by the hot fluid stream.

19. A method according to claim 18 in which the base cooling fluid is in a closed loop refrigeration cycle, and is a gas.

20. A method according to claim 19 in which the base cooling fluid is converted from a liquid to a vapor by heat rejected to it from the hot fluid stream, and the vapor is condensed to a liquid in passing through the cooling tower.

21. A method according to claim 18 in which the hot fluid stream is cooled in the cooling tower by indirect heat rejection to air.

22. A method according to claim 21 in which the temperature of the air, the size of the cooling tower and the rate of air flow through the cooling tower provide a limit as to the cooling of the hot fluid stream which can be effected by the base cooling fluid on hot days so that when such cooling is inadequate, supplemental cooling by means of the secondary cooling liquid is activated.

23. A method according to claim 22 in which the hot secondary cooling liquid removed from the hot reservoir is indirectly cooled at least partially by air.

24. A method according to claim 22 in which the hot secondary cooling liquid removed from the hot reservoir is indirectly cooled at least partially by base cooling fluid following cooling of the base cooling fluid in the cooling tower.

25. A method according to claim 23 or 24 in which the hot secondary cooling liquid is cooled primarily during evening hours and the cold secondary cooling liquid is used during daylight hours to cool the hot fluid stream.

26. A method according to claim 25 in which the hot fluid stream is waste steam from a steam driven turbine.

27. A method according to claim 26 in which the steam driven turbine is used to generate electric power and the steam is condensed to water in a steam condensor.

* * * * *

UNITED STATES PATENT AND TRADEMARK OFFICE

CERTIFICATE OF CORRECTION

PATENT NO. : 4,270,358

DATED : June 2, 1981

INVENTOR(S) : Matloob Husain et al

It is certified that error appears in the above-identified patent and that said Letters Patent are hereby corrected as shown below:

column 4, line 4, after "water" insert a comma (,), line 19, change "additon" to --addition--; columns 7 and 8 in Table 1, under that portion headed "System Operating at Ambient 97.5°F", change three columns to read:

| | | |
|---|---|---|
| 79 | 116 | 51 |
| 130 | - | 126 |
| 35 | - | 14.591 |
| 1.88 | - | 2.93 |
| X $10^7$ | - | X $10^8$ |

and in the "Remarks" insert --3-- before X $10^9$; and also in Table 1, in that portion headed "System Operating at Ambient 77.5°F" change the appropriate columns in part to read as follows:

| | | | | | | | | | | | | |
|---|---|---|---|---|---|---|---|---|---|---|---|---|
| 42 | 43 | 43 | 48 | 77 | 79 | 81 | 95 | 94 | 114 | 116 | 50 | 51 |
| 126 | 125 | 125 | 124 | -- | -- | 130 | 90 | 73 | 68 | 125 | 77.5 | 119 |

Signed and Sealed this

First Day of September 1981

[SEAL]

Attest:

GERALD J. MOSSINGHOFF

Attesting Officer

Commissioner of Patents and Trademarks